United States Patent [19]

Schmidt et al.

[11] 4,148,268

[45] Apr. 10, 1979

[54] METHOD OF AND APPARATUS FOR THE PRODUCTION OF BUTTON-HOLES ON A DOUBLE LOCK STITCH BUTTONHOLE SEWING MACHINE

[75] Inventors: Walter Schmidt; Gerhard Riss, both of Bielefeld, Fed. Rep. of Germany

[73] Assignee: Dürkoppwerke GmbH, Bielefeld, Fed. Rep. of Germany

[21] Appl. No.: 845,900

[22] Filed: Oct. 27, 1977

[30] Foreign Application Priority Data

Oct. 27, 1976 [DE] Fed. Rep. of Germany ..... 2648561

[51] Int. Cl.[2] ..... D05B 3/06

[52] U.S. Cl. ..... 112/264.1; 112/65; 112/255

[58] Field of Search ..... 112/264, 65, 66, 255, 112/254, 262

[56] References Cited

U.S. PATENT DOCUMENTS

| | | | |
|---|---|---|---|
| 3,628,480 | 12/1971 | Van Ness | 112/255 |
| 3,724,409 | 4/1973 | Olney | 112/255 |
| 3,824,938 | 7/1974 | Tolle | 112/70 |
| 3,877,405 | 4/1975 | Dorosz et al. | 112/255 |

FOREIGN PATENT DOCUMENTS

| | | | |
|---|---|---|---|
| 739559 | 9/1943 | Fed. Rep. of Germany | 112/65 |

*Primary Examiner*—H. Hampton Hunter
*Attorney, Agent, or Firm*—Karl F. Ross

[57] ABSTRACT

So-called raised buttonholes are sewn on a double-lock-stitch sewing machine with the fabric workpiece turned face down on the stitchplate of the sewing machine and the upper-thread tension being such that the interlocking loops of the upper and lower threads lie upon the downwardly facing side of the workpiece. According to the invention, the upper-thread tension at the end of a buttonhole-stitching cycle for the fastening stitch is increased above the lower-thread tension temporarily so that the interlocking loops of the upper and lower threads during this last fastening stitch lie within the thickness of the material or on the upper face of the downwardly turned workpiece.

10 Claims, 2 Drawing Figures

METHOD OF AND APPARATUS FOR THE PRODUCTION OF BUTTON-HOLES ON A DOUBLE LOCK STITCH BUTTONHOLE SEWING MACHINE

FIELD OF THE INVENTION

The present invention relates to a method of and an apparatus for the production of so-called "raised" buttonholes on double-lock-stitch buttonhole-sewing machines.

BACKGROUND OF THE INVENTION

Buttonholes produced on double-lock-stitch buttonhole-sewing machines are formed as so-called "raised buttonholes" for washable garments such as shirts, blouses and the like.

To produce such a buttonhole it is necessary to work with a relatively high upper-thread tension (about 300 g with higher and lower values possible according to the type of thread and material) and a relatively low lower-thread tension (about 30–40 g) so that the interengaged loops of the upper and lower threads are drawn to and lie upon the upper surface (outer surface) of the fabric.

The resulting buttonhole stitch gives the appearance of a manual sewing operation.

The aforedescribed method is, however, disadvantageous in two respects. Firstly, with the production of the buttonhole, a relatively large length of lower thread and a substantially shorter upper thread are used. Since the thread quantity for the lower thread is limited, e.g. by the capacity of the bobbin lying under the stitchplate, a single filling of the bobbin, depending upon the type of thread, can be used for only about one hundred shirt buttonholes. This means that for an average output of five thousand buttonholes per day, fifty bobbin changes may be required.

Secondly, because of the low consumption of the upper thread, which is used in a length only of about twice the length of the perimeter of the buttonhole, this relatively short length of thread must pass through the fabric and the eye of the needle some two hundred times back and forth. As a result, this length of upper thread is subjected to a high degree of wear so that the output capabilities of the machine, as a result of this excessive thread wear, cannot be fully utilized.

These disadvantages can be overcome by a conventional double-lock-stitch buttonhole-sewing machine in which the stitching mechanism, namely, the needle and gripper, are reversed in orientation. Thus, the gripper and the lower-thread bobbin are disposed above the stitchplate which the needle carrying the upper thread is disposed beneath the stitchplate. If then one operates with a high bobbin-thread tension and a low needle-thread tension, the loops of the two threads interengage at the upper side of the fabric but with the advantage for the sewing operation that relatively little bobbin thread and a larger amount of needle thread is consumed.

However, a buttonhole-sewing machine for carrying out this process is materially different from the usual commercial double-lock-stitch sewing machine and must be designed and manufactured separately.

This disadvantage can be obviated when, in accordance with the principles described in German Pat. No. 739,559, a modified technique is used.

In accordance with the method of this patent, the workpiece is turned face down upon the stitchplate of a double lock stitch buttonhole-sewing machine and the upper-thread tension is relatively low by comparison with the lower-thread tension, i.e. the lower-thread tension is greater than the upper-thread tension.

As a result, the interengaging loops of the upper and lower threads lie upon the underside of the workpiece, i.e. upon the outer face of the fabric which has been turned down to this end. Consequently, a large length of upper thread and relatively little lower thread is used to achieve the so-called raised buttonhole.

While this system has been found to be highly advantageous, there arises a problem at the end of the buttonhole-sewing cycle with respect to the fastening stitch which must form a type of knot. In the system of this patent, the knot appears upon the outer face of the garment, i.e. upon the downwardly turned surface of the fabric workpiece.

It is well-known that this system does not allow the fastening knot to be drawn into the fabric or to the reverse side therof as can be achieved with the previously described stitching systems. Thus, although the method and apparatus of the aforedescribed are highly advantageous for the stitching of the length or perimeter of the buttonhole to produce this so-called raised buttonhole, the disadvantage remains that the knot or final stitch lies on the exposed or outer face of the fabric.

OBJECTS OF THE INVENTION

It is the principal object of the present invention to provide an improved method of forming a so-called raised buttonhole whereby the latter disadvantage is obviated.

It is another object of this invention to provide an improved buttonhole-stitching apparatus, as part of the double-lock-stitch buttonhole-sewing machine, whereby the terminal stitch, i.e. the fastening knot, does not present itself upon the outer surface of the garment on which the raised buttonhole stitches are produced.

It is yet another object of the invention to provide a method of and an apparatus for eliminating the aforedescribed drawback of the system set forth in the German patent mentioned previously, i.e. a method of and apparatus for improving upon the basic system set forth in this patent.

SUMMARY OF THE INVENTION

The present invention is directed to an improvement upon the method and apparatus described in German Pat. No. 739,559 so as to eliminate the fastening knot which results on the face of the garment at the termination of the buttonhole stitching operation. According to the invention, following completion of the buttonhole stitching operation, during the formation of the fastening stitch ending the operation, the interengaging loops of the upper and lower threads are drawn into the thickness of the material or onto the upper surface or reverse thereof by a relatively simple and temporary increase of the upper-thread tension above that of the lower-thread tension.

In other words, the method of the present invention comprises the stitching of a so-called raised buttonhole on a fabric workpiece, e.g. a garment, having an outer face and an inner face whereby the outer face is turned face down upon the stitchplate and the buttonhole is stitched with a double-lock stitch sewing machine using an upper-needle thread and a lower-bobbin thread, the bobbin thread having a greater tension than the needle thread so that, along the perimeter of the buttonhole, the interengaging thread loops of the upper and lower threads are drawn downwardly to lie upon the outer face of the workpiece, i.e. the face turned toward the stitchplate. The additional step of the present invention involves the temporary increase of the upper-thread tension above that of the lower-thread tension at the last stitch of the buttonhole-sewing cycle so that the interengaging thread loops of the upper and lower threads are drawn into the thickness of the fabric or onto the upper surface or reverse thereof.

An apparatus for carrying out the process of the present invention comprises, in addition to the usual double-lock-stitch buttonhole-sewing apparatus necessary for the operations described in German Pat. No. 739,559, a thread-tensioning means which can comprise a conventional thread-tension adjuster having a pair of opposed and relatively movable disks between which the upper thread passes. According to the invention, a control pin is provided to vary the relative spacing of the two disks, this pin being controlled, in turn, by a cam on the machine and advantageously on the control disk of the buttonhole-sewing machine via a force-transmitting body such as a cam-follower lever so that the thread braking of the upper thread is briefly increased during the terminal phase of the buttonhole stitching operation.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
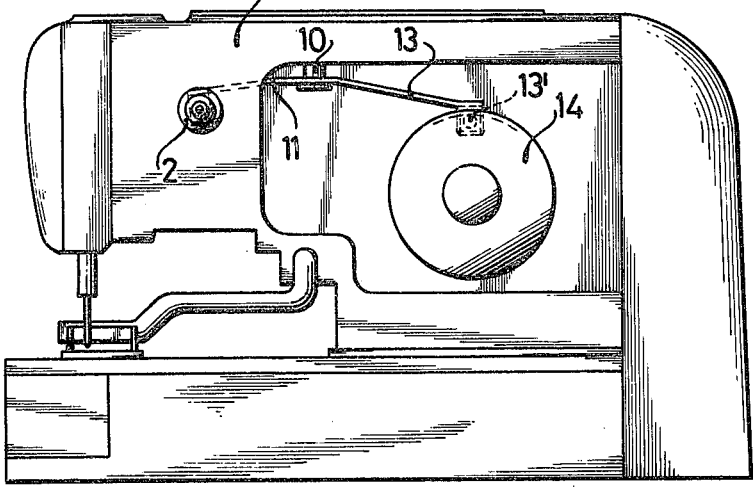
FIG. 1 is a side-elevational view of a conventional double-lock stitch buttonhole-sewing machine of the Dürkopp-type 556 adapted to carry out the process described in the aforementioned German application and illustrated somewhat diagrammatically, the machine being equipped with the thread-tension control means of the present invention.

While this machine has been illustrated diagrammatically, it can be seen that it comprises a machine housing 1 which is laterally provided with a thread-tension device 2 over which passes the upper thread of the sewing machine to the needle. The lower thread-tensioning device, bobbin, fabric-advance structure and the foot guiding the fabric in the buttonhole configuration are all conventional in this type of machine and have not been described. Similarly, the drive means for the machine and the main drive shaft of the machine have not been illustrated either in any detail.

According to the invention, the thread-tension device 2 comprises a pair of tension disks 3 and 4 which are mounted so as to be axially shiftable upon a bolt 5 threaded into the machine housing 1.

The disk 3 normally rests against a shoulder of the bolt 5 while the disk 4 is urged toward the disk 3 by a compression spring 6 of adjustable force. The force may be adjusted by the milled-head screw 7 threaded onto the free end of the bolt 5. The disk 4 is engaged by the broad base of a frustoconical basket 8 upon which one end of the spring 6 bears, this frustoconical compression spring being seated against the milled-periphery nut 7 serving to adjust the compressive force of the spring.

According to the invention, the bolt 5 is provided with an axial bore through which a rod 9 extends, the rod being axially shiftable and being connected to or bearing upon the basket 8.

On the inward or free end of the rod 9, the arm 11 of a lever 12 bears, the lever 12 being fulcrumed on a pivot 10 to the machine housing 1.

The force-transmitting lever 12 is of the double-arm-type and has its other arm 13 engaging a cam 14' of the control disk 14 of the buttonhole-sewing machine. To this end, the arm 13 has a cam follower 13' which engages the cam surface 14'.

The control disk 14 is driven during the production of a buttonhole through one revolution about its axis and controls the foot or guide for displacing the fabric through the pattern of the buttonhole beneath the needle and above the hole in the stitchplate accommodating the needle. Below the stitchplate, the usual gripper forms the lower thread loops which interlock with the upper thread loops to produce the double-lock-stitch using the upper and lower threads supplied through the needle eye and from the bobbin respectively.

In other words, the control disk 14 guides the presser foot in a pair of linear movements adapted to form the opposite longitudinal sides of the buttonhole as well as the arcuate or return movements adapted to form both bights in the raised buttonhold seam at the ends of the buttonhole.

Figure 2:
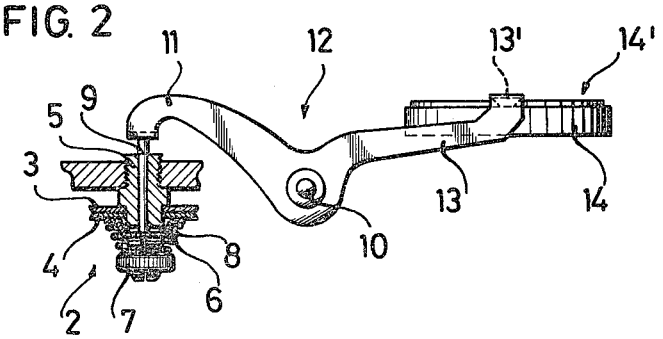
FIG. 2 is a detail view of the thread-control means of the invention shown in somewhat diagrammatically and partly broken away.

During the sewing of the complete buttonhole, the cam follower 13' rests upon the cam surface 14' to hold the basket 8 downwardly in the showing of FIG. 2, thereby relieving the pressure of the spring 6 upon the disk 4 and maintaining a low tension upon the upper thread. The upper thread is thus at a lower tension than the lower thread and the upper-thread loops are thereby drawn to the underside of the fabric which has its outer face turned downwardly upon the stitchplate so that a raised buttonhole is formed on the underside of the workpiece upon the stitchplate. This under side of the workpiece corresponds to the outer face of the garment.

In other words, the upper thread is only slightly braked during the stitching of the perimeter of the pattern of the buttonhole. At the last stitch, in the region of the second bight, i.e. during the stitching of the knot terminating the buttonhole operation, the cam follower 13' falls into a recess in the surface 13' as can be seen in FIG. 2, thereby relieving the pressure of the arm 11 on the rod 9 and permitting the full force of the spring 6 to press the disk 4 toward the disk 3 and increase the tension upon the upper thread until the upper-thread tension exceeds the tension of the lower thread.

Since the upper-thread tension is in excess of the lower-thread tension, the lower thread loop and the region in which the upper-thread and lower-thread loops interlock, are drawn into the thickness of the fabric or onto the upwardly turned face thereof, this face corresponding to the inner surface of the garment.

As the control disk 14 turns further, the cam follower 13' is displaced out of the recess in the surface 14' and the upper-thread tension is again relieved whereupon the upper thread can be cut and the process repeated for the next buttonhole.

We claim:

1. In a method of forming a buttonhole on a double-lock-stitch buttonhole-sewing machine having a stitch plate, a machine support provided with a needle above said stitch plate whereby said needle carries an upper thread forming a double-lock-stitch with a lower thread beneath said stitch plate, the tension of said upper thread being less than that of said lower thread during the formation of a buttonhole outline on the workpiece having its outer face turned downwardly upon said stitchplate, and a control disk for displacing said workpiece relative to said needle to form the buttonhole pattern wherein the pattern of the buttonhole is stitched with the relatively low upper-thread tension and the relatively high lower-thread tension so that interlocking loops of the upper and lower threads are drawn to the downwardly turned face of the fabric, the improvement which comprises stitching a fastening stitch through the fabric upon completion of the buttonhole-stitching pattern and, during the formation of said fastening stitch, temporarily increasing the tension of said upper thread above that of said lower thread to draw the interlocking loops of the upper and lower threads of said fastening stitch upwardly from the downwardly face of the fabric.

2. The improvement defined in claim 1 wherein the interlocking loops of the upper and lower threads of said fastening stitch are drawn into the thickness of the fabric.

3. The improvement defined in claim 1 wherein the interlocking loops of said upper and lower threads of said fastening stitch are drawn to the upwardly turned face of said fabric.

4. In an apparatus for producing a raised buttonhole upon a fabric having an outer face which comprises a double-lock-stitch buttonhole-sewing machine having a stitchplate, a machine support provided with a needle above said stitchplate whereby said needle carries an upper thread forming a double-lock-stitch with a lower thread beneath said stitchplate, the tension of said upper thread being greater than that of said lower thread during the formation of a buttonhole outline on the workpiece having said outer face turned downwardly upon said stitchplate, and a control disk for displacing said workpiece relative to said needle to form the buttonhole pattern, the improvement which comprises means for temporarily increasing the upper-thread tension above that of the lower thread for the formation of a terminal fastening stitch at the end of the stitching of the buttonhole pattern whereby interlocking loops of the upper and lower threads are drawn away from the downwardly turned face of said workpiece.

5. The improvement defined in claim 4 wherein said means for temporarily increasing the tension of said upper thread comprises a thread-tensioning device mounted on siad support and engaging said upper thread, camming means on said disk, and cam-follower means engaging said camming means on said disk for controlling said device to increase the thread tension of said upper thread upon termination of the stitching of the buttonhole.

6. The improvement defined in claim 5 wherein said device comprises a pair of disks, a spring urging one of said disks toward the other of said disks, a rod acting upon said spring to relieve the spring pressure of said one of said disks toward said other disk, said cam-follower means including a lever fulcrumed on said support and engaging said rod.

7. The improvement defined in claim 6 wherein said device includes a frustoconical basket adapted to bear upon said one of said disks, said spring bearing upon said basket, said rod engaging said basket.

8. The improvement defined in claim 7 wherein said device comprises a bolt threaded into said support and formed with a bore, said disks being mounted upon said bolt and said rod passing through said bore.

9. The improvement defined in claim 8 wherein said bolt is formed with a shoulder, said other of said disks resting against said shoulder, said device further comprising a milled nut threaded onto said bolt and forming a seat for said spring.

10. The improvement defined in claim 9 wherein said lever is a double-arm lever fulcrumed intermediate its ends, one of said ends of said lever forming an arm bearing on said rod, the other end of said lever forming a further arm engaging said disk.

* * * * *